US005410786A

United States Patent [19]

Bogucki-Land

[11] Patent Number: 5,410,786

[45] Date of Patent: May 2, 1995

[54] PROCESS AND ARRANGEMENT FOR THE WARPING OF THREADS ONTO A DRUM HAVING A CONICAL SURFACE

[75] Inventor: Bogdan Bogucki-Land, Offenbach am Main, Germany

[73] Assignee: Karl Mayer Textilmaschinenfabrik GmbH, Obertshausen, Germany

[21] Appl. No.: 197,056

[22] Filed: Feb. 16, 1994

[30] Foreign Application Priority Data

Feb. 18, 1993 [DE] Germany ..... 43 04 956.7

[51] Int. Cl.[6] ..... D02H 13/34; B65H 54/12

[52] U.S. Cl. ..... 28/191; 28/185

[58] Field of Search ..... 28/185, 191

[56] References Cited

U.S. PATENT DOCUMENTS

| | | | |
|---|---|---|---|
| 4,670,953 | 6/1987 | Kanda et al. | 28/185 |
| 4,974,301 | 12/1990 | Beerli et al. | 28/185 X |
| 5,107,574 | 4/1992 | Beerli et al. | 28/191 |

FOREIGN PATENT DOCUMENTS

| | | | |
|---|---|---|---|
| 0034610 | 6/1991 | European Pat. Off. | 28/185 |
| 2510517 | 10/1978 | Germany . | |
| 2748621 | 5/1979 | Germany . | |
| 3432276 | 4/1985 | Germany . | |
| 3024095 | 1/1989 | Germany . | |
| 3913381 | 10/1990 | Germany . | |

*Primary Examiner*—Andrew M. Falik
*Attorney, Agent, or Firm*—Omri M. Behr; Matthew J. McDonald

[57] ABSTRACT

Threads are warped with an axially moveable slide onto a drum having a cone, into a plurality of successive warp bands. The threads are warped for a first band based on a predetermined advancement schedule for the slide. The warping of the first band, after a predetermined initial phase, is performed by: (a) measuring an aspect parameter, signifying the form of the winding of the first band, (b) correcting the predetermined advancement schedule of the slide based on a comparison of the aspect parameter and a targeted parametric value to compose a corrected advancement schedule, and (c) storing a successive plurality of descriptive parameters signifying the evolving form of the winding of the band, when successive revolutions of the drum meet a predetermined drum schedule. The threads are warped for successive ones of the bands by: (a) advancing the slide according to the corrected advancement schedule, at least for times after an initial phase, (b) measuring the descriptive parameter according to the predetermined drum schedule during the warping of the bands, and (c) adjusting tension of thread being delivered, depending upon current deviations of the descriptive parameter from corresponding stored values of the descriptive parameter.

26 Claims, 1 Drawing Sheet

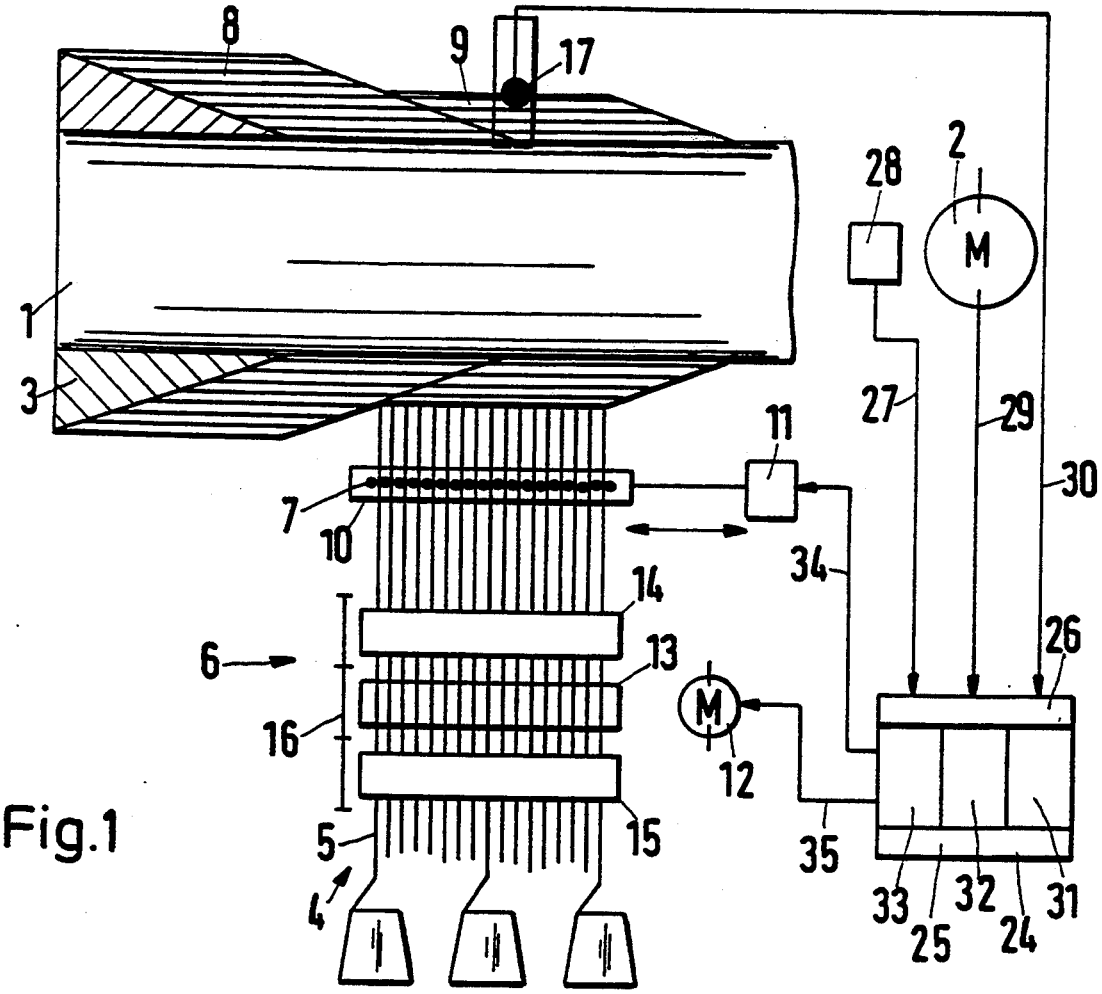
Fig.1
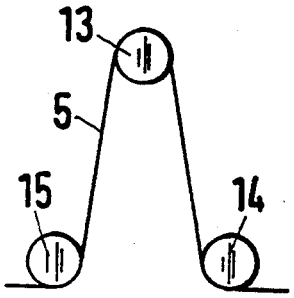
Fig.2
Fig.3
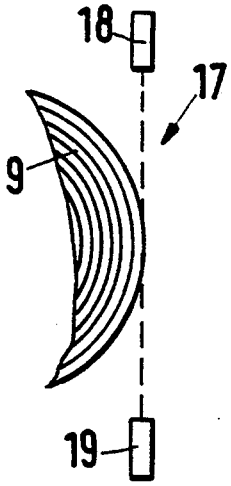
Fig.4
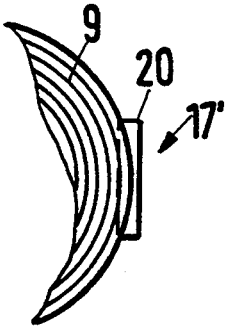
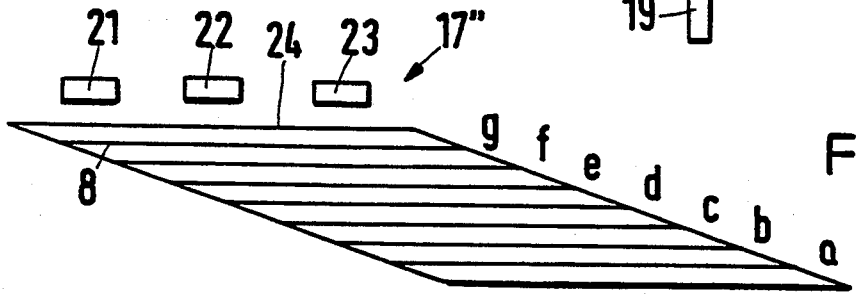
Fig.5

PROCESS AND ARRANGEMENT FOR THE WARPING OF THREADS ONTO A DRUM HAVING A CONICAL SURFACE

BACKGROUND OF THE INVENTION

1. Field of the Invention

The invention is directed to a process for the warping of threads on a warping machine having a drum provided with a cone, into a plurality of sequentially following warp bands. These bands are fed by a slide, moveable axially relative to the drum. During the warping of the first band, after a predetermined initial phase, a correction of the prescribed slide advancement occurs, based upon the target/actual comparison of an aspect parameter characterizing the form of the winding of the band. During the warping of the sequential bands in the initial phase of the prescribed slide advancement and thereafter the corrected slide advancement is copied.

The invention is further directed to a warping machine for carrying out this process, having: a drum with a cone; a slide displaceable relative to the drum for providing warp bands (and having an adjustable slide advancement drive); a measuring arrangement for the determining the above noted aspect parameter; an arrangement for the correcting the slide advancement drive in response to the target/actual comparison of the aspect parameter; and a storage means for storing data obtained from the first band wind and the slide advancement and copying the same during the following winds.

2. Discussion of the Prior Art

DE-OS 34 32 276 discloses a conical warping machine of the foregoing type, wherein the threads are pulled off a spool creel and wound onto a self-rotating drum. To correlate the band wind to the provided cone, the drum and a slide (carrying a thread reed) are axially displaceable relative to each other.

After a predetermined initial phase which is determined by a predetermined number of rotations of the drum, the set-back timing path is measured by a radially displaceable contact roller and compared with the corresponding target value. At the occurrence of a deviation therefrom, a deviation correcting change occurs in the slide advancement. In the subsequent winds the initial phase of the slide advancement and the subsequently corrected slide advancement is copied.

DE AS 25 10 517 suggests another mode. The slide advancement is positively coupled to a contact roller so that the slide advancement increases proportionately to the increase in wind diameter. However, there is no control on whether the first band wind has the same inclination to the cone. Furthermore, the wind is continually measured and recorded relative to the number of rotations. During the warping of the subsequent bands corresponding curves are drawn and compared with a curve of the first band. When deviation occurs, the contact pressure of the contact roller is altered to the extent that the thread tension corresponds to the correct value of the first band.

DE OS 39 13 381 describes a procedure for the formation of a warp beam having a cylindrical wind. A rotational counter transmits the number of rotations. A measuring device determines the winding diameter. Both of these should occur in a predetermined target relationship. If the actual relationship does not correspond thereto, without measuring the warp thread tension, the difference should be compensated for by altering the provision speed of the thread sheet; for example by raising the rotational speed of the turning rollers. This correction can occur after a predetermined number of rotations.

This reference does not concern itself with the problems inherent in conical warping. It does not in fact progress beyond that which was disclosed in DE AS 25 10 517 in conjunction with conical warping.

Accordingly, there is a need for an improved mode for warping threads in a more even manner than was available heretofore.

SUMMARY OF THE INVENTION

In accordance with the illustrative embodiments demonstrating features and advantages of the present method, a process is provided for warping threads with a slide onto a drum having a cone into a plurality of successive warp bands. The drum and the slide are relatively and axially displaceable to shape the bands, their windings and their form. The process includes the steps of warping the threads for a first one of the bands based on a predetermined advancement schedule for the slide. The warping of the first one of the bands, after a predetermined initial phase, is performed by: (a) measuring an aspect parameter signifying the form of the winding of the first one of the bands, (b) correcting the predetermined advancement schedule of the slide based on a comparison of the aspect parameter and a targeted parametric value to compose a corrected advancement schedule, and (c) storing a successive plurality of descriptive parameters signifying the evolving form of the winding of the band when successive revolutions of the drum meet a predetermined drum schedule. The process also includes the step of warping the threads for successive ones of the bands by: (a) advancing the slide according to the corrected advancement schedule, at least for times after an initial phase, (b) measuring the descriptive parameter according to the predetermined drum schedule during the warping of the bands, and (c) adjusting tension of thread being delivered depending upon current deviations of the descriptive parameter from corresponding stored values of the descriptive parameter.

A related warp machine of the same invention can warp threads into a plurality of successive warp bands. The machine has a drum with a cone and a slide having an adjustable slide advancement drive. The slide and the drum are relatively displaceable for laying the warp bands in a laterally adjustable manner. The machine also includes a tensioning arrangement having an instruction input and being responsive to signals thereon for altering thread tension on the warp bands. Also included is a measuring arrangement including: (a) means for providing a signal signifying an aspect parameter indicating the form of windings of the warp bands, and (b) means for providing a signal signifying a descriptive parameter, characterizing the form of winding of the warp bands. The machine further includes a processing arrangement coupled to the measuring arrangement, the tensioning arrangement, and the slide. The processing arrangement includes: (a) a storage means having means for storing for a first one of the warp bands, signals from the measuring arrangement, including signals signifying the descriptive parameter, and (b) a comparison means. The comparison means includes: (i) means responsive to signals from the measuring arrangement for correcting the slide advancement drive in response to a comparison of the aspect parameter and a predetermined targeted parametric value during a first wind and for keeping the slide advancement drive corrected during following winds, and (ii) means for providing a deviation signal in response to current deviations of the descriptive parameter from corresponding stored values of the descriptive parameter in the storage means. The deviation signal is applied to the instruction input of the tensioning arrangement.

BRIEF DESCRIPTION OF THE DRAWINGS

The present invention can be illustrated, with respect to the preferred embodiments, in the following drawings, wherein:

FIG. 1 is a schematic illustrating the warping machine and the process according to the principles of the present invention;

FIG. 2 is a side elevational view of the tensioning arrangement of FIG. 1;

FIG. 3 shows a light barrier utilized as diameter measuring arrangement;

FIG. 4 schematically shows an electronic scanning camera used as the diameter measuring arrangement; and FIG. 5 illustrates a band measurement process using a measuring arrangement comprising contactless, switching sensors.

DETAILED DESCRIPTION OF THE PREFERRED EMBODIMENTS

A warping drum 1 is driveable by a motor 2. One end of drum 1 carries a cone 3. A warp sheet 5 is provided from the indicated creel 4, over a thread tensioning arrangement 6 and a thread reed 7. This equipment thereby sequentially forms a first band 8 and a successive band 9. For this purpose, the thread reed 7 is mounted on a slide 10, which is axially displaceable relative to the warping drum 1 by an adjustable slide advancement drive 11.

Thread tensioning arrangement 6 comprises three tensioning rollers, namely the central roller 13 which is driven by motor 12 and the outer tensioning rollers 14 and 15, which are connected to the central tensioning roller 13 via a gearing arrangement 16. Motor 12 is controlled by a signal on instruction input 35.

Measuring arrangement 17 is coupled to move with slide 10 from band to band and also to follow the wind circumference radially. This radial motion serves as a means for measuring the diameter of the winds 8 and 9, which is referred to as an aspect parameter or a descriptive parameter. This diametric measurement is used as a controlling parameter for both the first and subsequent bands, although in other embodiments one parameter (an aspect parameter) can be influential in the first band and another parameter (the descriptive parameter) can be influential for the second band.

The measuring arrangement 17 can be provided in the form of a light beam that acts like a light barrier (light box), including a light source 18 and a light detector 19, as is schematically illustrated in FIG. 3.

Alternatively as illustrated in FIG. 4, alternate measuring arrangement 17' is in the form of a scanning camera 20 or similar form of video camera. FIG. 5 illustrates yet another measuring arrangement 17' which comprise three non-contacting, that is to say, inductive or capacitive switching sensors 21, 22 and 23, which radially follow the wind circumference. Thus, it may be determined whether the circumferential surface 24 of the wind 9 has a surface line which runs parallel to the drum axis or tilts at an angle thereto.

A digital computer 24 (referred to as a processing arrangement) may be a microprocessor with adequate memory for the program described herein, although a general purpose computer may be used instead. Computer 24 has a key pad 25 into which the desired instructions can be entered manually, and a data input means 26 which is connected to three signal conduits. Over signal lines 27 are transmitted a signal indicating the number of rotations of drum 1, measured by counting means 28. The number of rotations of motor 2 are sent via signal lines 29. Signal line 30 carries the measuring result of measuring arrangement 17.

Computer 24 further comprises a storage means 31, a comparison means 32 and an output means 33. This latter, via instruction conduit 34 provides a forward movement signal to the setting drive 11 and via the instruction input 35, a rotation signal (that is, a deviation signal) to motor 12.

During the warping of the winding of the first band 8 (which proceeds with constant thread tension) during the initial phase (for example, during the first hundred rotations of drum 1), the slide advancement of the slide 10 is conducted based upon the experience of the service person or upon the basis of a calculation determined by the material to be warped. At the end of this initial phase (work point a in FIG. 5), by the assistance of measuring arrangement 17, an aspect parameter characterizing the band wind 4 (here the wind diameter) is compared in comparison means 32 of the computer 24 with a targeted parametric value stored in data storage means 31. The targeted parametric value comes from a predetermined advancement schedule (a data table) signifying the desired wind diameter for a scheduled number of revolutions of drum 1. Wind diameter and slide advancement are closely related since cone 3 inherently has a linear relation between axial and radial displacement. A correctly wound band will climb the cone 3 and follow the same linear relation between axial and radial displacement.

Thus, the preferred process during the warping of the bands measures at a regular number of elapsed revolutions of the drum 1, a descriptive parameter characterizing a band wind form. These descriptive parameters of the first band 8 are stored and the descriptive parameters of the subsequent winds are compared thereto. In the case of deviation of the mutually compared descriptive parameters, the thread tension of the delivered thread 5 is corrected.

This approach relies rests upon a recognition that following a predetermined slide advancement and/or the modified slide advancement, corrected as it occurs in the first band wind 8, does not achieve in the subsequent winds a consistently similar wind diameter. Other perturbing factors such as the change in thread quality, differences in thread tension, and the like, lead to differences in the wind diameter. Even if these differences are not very large, they must be taken into consideration. This is so because the warp beam 1, which during the re-warping from the warp drum 1 takes up a plurality of threads 5, yields different thread lengths during each rotation.

In accordance with the preferred embodiment of the present invention, during the warping, the sequential winds do not rely merely on a duplication of the slide advancement. Rather, by means of further corrective measures, the several subsequent winds have the same diameter as the first band wind 8.

If there is no correspondence (that is, a current deviation) between the actual diameter of band 8 (the aspect parameter) and the targeted parametric value, then the slide advancement schedule of slide 10 is corrected by applying the appropriate signal to the setting drive 11. Additionally, the measured aspect parameter is deposited in the data storage means 31 as a characterizing aspect magnitude of the band wind form. This data is stored as a corrected advancement schedule.

At work points B through G after a predetermined number of rotations designated by a predetermined drum schedule (for example, after a hundred rotations), these measurements are again taken and recorded in storage means 31.

For this purpose, a plurality of data must be stored. Specifically, descriptive parameters of the first band wind 8 are stored and compared with the later measured descriptive parameters. A detected deviation is used to alter the thread tension as will be described presently. By this means one can even correct those errors that are not correctable by simply using the corrected slide advancement. Significantly, the changes needed to obtain the desired thread tension are so small that during the further processing of the threads, they do not give rise to interference with the processing of the yarn.

In this preferred process, the descriptive parameter comparison and the correction of the thread tension in each subsequent wind is carried out repetitively. Thus the thread tension is altered several times. This ensures that the internal structure of the subsequent winds corresponds with that of the first band.

When, the aspect parameter (e.g. a measurement associated with slide control during the first band) is the same parameter as the descriptive parameter, one avoids any need to have any additional measuring arrangements for the determination of the descriptive and aspect parameter.

Furthermore, during the warping of the first band 8 the comparison of target/actual values and the consequential correction of the slide advancement is performed repeatedly. Thus the first band wind 8 can be built up even more exactly. The frequent need to determine the aspect parameter does not give rise to any great difficulties, because the aspect parameter and the descriptive parameter are the same in this preferred embodiment.

If desired, at these particular work points, further corrections may be made in the advancement of slide 10. During the warping of the second band 9 and/or further subsequent winds, the particular descriptive parameters which were measured at work points A through G by measuring arrangement 17 are compared with the stored descriptive parameters for the corresponding work points determined in the first band wind 8. In case of non-correspondence the appropriate signal is given to motor 12, which by acceleration or deceleration of the rotation of the tensioning rollers 13, can alter the thread tension.

In this way, there is provided a correction by means of which the wind diameter of all following winds are matched to that of the first wind. These corrections occur at the designated work points A through G. When drum 1 is fully warped, there is provided a total wind of the same diameter.

Determining the aspect and/or descriptive parameter, as well as the correction of the slide advancement and/or the thread tension is carried out during the continual rotation of the drum. Thus, the conventional interruptions of the warp drive are avoided. In spite of the greater number of corrective steps, the average warping speed is not reduced.

This speediness can be especially realized when the comparison of the descriptive parameter and the correction of the thread tension follow automatically. With such automation, measurement, comparison and correction follows in such rapid succession that a continuous running of the drum is permissible.

In one preferred embodiment, the determination of the aspect and descriptive parameters may occur without physical contact. This gives rise to a more exact value then is possible with a contact roller or the like. Furthermore, the winding is not altered by mechanically biasing the wind.

Preferably, the wind diameter is used as the aspect and/or descriptive parameters. Where the wind diameter is subtracted from the drum diameter, one obtains the wind thickness. Such measurements are comparatively simple to carry out.

Furthermore, the aspect and/or descriptive parameter can also be a measure of the tilt angle of the outside of the wind. This angle can be similarly determined by measurements on the outer surface of the wind.

The apparatus utilized for carrying out this invention can have: (a) a measuring arrangement for the determination of a descriptive parameter characterizing the band wind form, (b) a storage means for the descriptive parameter obtained from the first band wind, (c) a descriptive parameter comparison means, and (d) a tensioning arrangement for the warp bands with the assistance of which the thread tension may be altered in dependence upon the comparison result. The additionally required structure does not substantially burden the equipment.

It is desirable to provide a tensioning arrangement, which is driven independently of any tension roller driven by the warping drum. This provides a pretake-off intermediate between the creel and the warping machine. The rate of rotation of such a tensioning roller can be readily influenced.

It is also possible to maintain the slide 10 at a given position and to move the drum 1 by means of the setting drive 11. Rather than measuring the number of rotations and rate of rotation of motor 2, it is possible to determine from computer 24 an appropriate angle coding at the shaft of motor 2. The tensioning arrangement 6 can also be formed by a forced drive of the creel spools or by means of a thread brake.

A preferred measuring arrangement combines the features of measuring the aspect parameter and measuring the descriptive parameter. This preferred measuring arrangement is formed by a single measuring arrangement, which leads to further constructive simplifications.

The contemplated measuring arrangements sense the wind diameter, for example by sensing axial variations. This type of measurement can determine the inclination of the circumferential surface line of the band wind to the drum axis. Various transducers can perform this function. For example, a light barrier serving as a measuring arrangement, an electronic camera, or at least one non-contacting switch could be used in a warping machine of the present invention.

Digital computer 24 having a data storage means can facilitate the descriptive parameter comparison process.

This comparison can include a calculation of the descriptive parameter and automatic adjustment of the thread tension. Such a computerized arrangement gives rise to very simple means for the automatic adjustment of thread tension.

I claim:

1. Process for warping threads with a slide onto a rotating drum having a cone into a plurality of successive warp bands, said drum and said slide being relatively and axially displaceable with respect to each other to shape the bands, their windings and their form, said process comprising the steps of:

warping the threads for a first one of the bands based on a predetermined advancement schedule for the slide, the warping of the first one of the bands, after a predetermined initial phase, being performed by:

(a) measuring an aspect parameter signifying the form of the winding of the first one of the bands, (b) correcting the predetermined advancement schedule of the slide based on a comparison of the aspect parameter and a targeted parametric value to compose a corrected advancement schedule, and (c) storing a successive plurality of descriptive parameters signifying the evolving form of the winding of the band when successive revolutions of the drum meet a predetermined drum schedule;

warping the threads for successive ones of the bands by:

(a) advancing the slide according to the corrected advancement schedule obtained during the first one of the bands, at least for times after the initial phase, (b) measuring the descriptive parameter according to the predetermined drum schedule during the warping of the bands, and (c) adjusting tension of thread being delivered depending upon current deviations of the descriptive parameter from corresponding stored values of the descriptive parameter.

2. Process in accordance with claim 1 wherein the step of adjusting tension in response to deviations of the descriptive parameter is performed, in each of the successive warp bands, repeatedly and sequentially.

3. Process in accordance with claim 1 wherein the step of adjusting tension is performed with the aspect parameter being used as the descriptive parameter.

4. Process in accordance with claim 1 wherein during the warping of the first band the step of correcting the predetermined advancement schedule based on the comparison to the targeted parametric value is performed repeatedly.

5. Process in accordance with claim 1 wherein the following steps are performed while the drum continues to rotate: (a) measuring the aspect parameter, and (b) correcting the predetermined advancement schedule to compose the corrected advancement schedule.

6. Process in accordance with claim 1 wherein the following steps are performed while the drum continues to rotate: (a) measuring the aspect parameter, and (b) adjusting thread tension.

7. Process in accordance with claim 1 wherein the following steps are performed while the drum continues to rotate: (a) measuring the descriptive parameter, and (b) correcting the predetermined advancement schedule to compose the corrected advancement schedule.

8. Process in accordance with claim 1 wherein the following steps are performed while the drum continues to rotate: (a) measuring the descriptive parameter, and (b) adjusting thread tension.

9. Process in accordance with claim 4 wherein the following steps are performed while the drum continues to rotate: (a) measuring the aspect and the descriptive parameter, (b) adjusting thread tension, and (c) correcting the predetermined advancement schedule to compose the corrected advancement schedule.

10. Process in accordance with claim 1 wherein the step of adjusting thread tension presently follows current deviation of the descriptive parameter from the corresponding stored values of the descriptive parameters.

11. Process in accordance with claim 3 wherein the step of measuring the descriptive parameter is performed without contacting the winding on the drum.

12. Process in accordance with claim 3 wherein the step of measuring the aspect and descriptive parameters is performed without contacting the winding on the drum.

13. Process in accordance with claim 1 wherein the step of measuring the descriptive parameter is performed by measuring diameter for a current one of the windings.

14. Process in accordance with claim 1 wherein the step of measuring the aspect and the descriptive parameter is performed by measuring diameter for a current one of the windings.

15. Process in accordance with claim 3 wherein the step of measuring the aspect and descriptive parameter is performed by determining the angle of tilt between the outside of the winding and the axis of the drum.

16. Warping machine for warping threads into a plurality of successive warp bands, comprising:

a drum having a cone;

a slide having an adjustable slide advancement drive, said slide and said drum being relatively displaceable for laying said warp bands in a laterally adjustable manner;

a tensioning arrangement having an instruction input and being responsive to signals thereon for altering thread tension on the warp bands;

a measuring arrangement including (a) means for providing a signal signifying an aspect parameter indicating the form of windings of the warp bands, and (b) means for providing a signal signifying a descriptive parameter characterizing the form of winding of the warp bands; and a processing arrangement coupled to said measuring arrangement, said tensioning arrangement, and said slide, including:

(a) a storage means having means for storing for a first one of the warp bands, signals from said measuring arrangement, including signals signifying said descriptive parameter and positioning of said slide, and (b) a comparison means including:

(i) means responsive to signals from said measuring arrangement for correcting the slide advancement drive in response to a comparison of the aspect parameter and a predetermined, targeted parametric value during a first wind and for keeping the slide advancement drive corrected during following winds based on signals stored in said storage means during an initial wind, and (ii) means for providing a deviation signal in response to current deviations of the descriptive parameter from corresponding values of the descriptive parameter stored in said storage means during said first wind, said deviation signal being applied to said instruction input of said tensioning arrangement at least during winds following said initial wind.

17. Warping machine in accordance with claim 16 wherein the tension arrangement comprises:

a tensioning roller adapted to be driveable independently of the drum.

18. Warping machine in accordance with claim 17 wherein the measuring arrangement has a single measuring arrangement and the aspect parameter and descriptive parameter are the same parameter.

19. Warping machine in accordance with claim 16 wherein the measuring arrangement has a single measuring arrangement and the aspect parameter and descriptive parameter are the same parameter.

20. Warping machine in accordance with claim 19 wherein the measuring arrangement is adapted to sense wind diameter.

21. Warping machine in accordance with claim 16 wherein the measuring arrangement is adapted to sense wind diameter.

22. Warping machine in accordance with claims 18 wherein the measuring arrangement is adapted to sense the angle of tilt between the outside of the warp bands and the axis of the drum.

23. Warping machine in accordance with claim 18 wherein the measuring arrangement comprises a light barrier.

24. Warping machine in accordance with claim 18 wherein the measuring arrangement comprises an electronic camera.

25. Warping machine in accordance with claim 18 wherein the measuring arrangement comprises at least one non-contacting switch.

26. Warping machine in accordance with claim 16 wherein the processing arrangement comprises:

a digital computer having a memory and operative to compare the actual and targeted values of the descriptive parameter and to calculate the descriptive parameter and automatically adjust the thread tension by adjusting the deviation signal.

* * * * *